United States Patent [19]

Kramer et al.

[11] 4,137,607

[45] Feb. 6, 1979

[54] BUTTON, PARTICULARLY FOR CLOTHING PIECES

[75] Inventors: Friedhelm Kramer, Ennepetal-Milspe; Günter Wolfertz, Wuppertal-Barmen; Harald Klaus, Wuppertal-Elberfeld; Raimund Stanik, Wuppertal-Beyenburg; Walter Ramspott, Wuppertal-Cronenberg, all of Fed. Rep. of Germany

[73] Assignee: Schaeffer-Homberg GmbH, Wuppertal, Fed. Rep. of Germany

[21] Appl. No.: 777,097

[22] Filed: Mar. 14, 1977

Related U.S. Application Data

[62] Division of Ser. No. 626,987, Oct. 29, 1975, Pat. No. 4,033,012.

[30] Foreign Application Priority Data

| | | | |
|---|---|---|---|
| Jan. 30, 1975 | [DE] | Fed. Rep. of Germany | 2503798 |
| Feb. 7, 1975 | [DE] | Fed. Rep. of Germany | 2505139 |
| Jul. 16, 1975 | [DE] | Fed. Rep. of Germany | 2531728 |

[51] Int. Cl.[2] ..... A44B 1/42

[52] U.S. Cl. ..... 24/95

[58] Field of Search ..... 24/90 R, 227, 229, 94, 24/95, 96

[56] References Cited

U.S. PATENT DOCUMENTS

| | | | |
|---|---|---|---|
| 452,138 | 5/1891 | Hyde, Jr. | 24/95 |
| 983,410 | 2/1911 | Spooner et al. | 24/94 |
| 1,359,038 | 11/1920 | Beaumont | 24/90 R |
| 1,988,233 | 1/1935 | Berendt | 24/95 |
| 2,975,495 | 3/1961 | Wolf et al. | 24/95 |

FOREIGN PATENT DOCUMENTS

| | | | |
|---|---|---|---|
| 284866 | 6/1950 | Switzerland | 24/96 |
| 837684 | 3/1957 | United Kingdom | 24/227 |

*Primary Examiner*—Kenneth J. Dorner
*Attorney, Agent, or Firm*—Martin A. Farber

[57] ABSTRACT

A double-layered counter holder plate having a support bent from an inner layer thereof, the support supporting the inner and outer layers spaced opposite one another by resting on an inner surface of the spaced layer, the latter layer serving as a support for rolling the claws of a closure, the inner layer being overlapped by the claws.

19 Claims, 26 Drawing Figures

FIG. 6
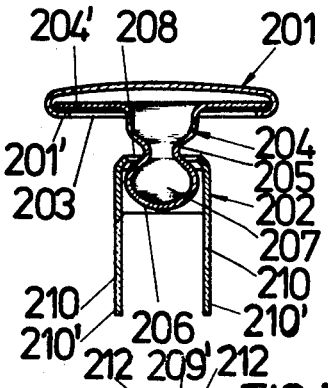
FIG. 8
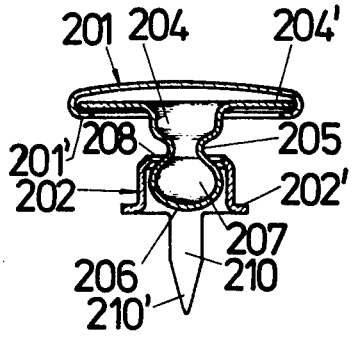
FIG. 7
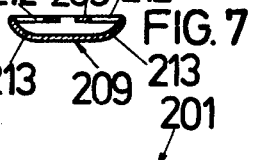
FIG. 9
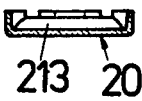
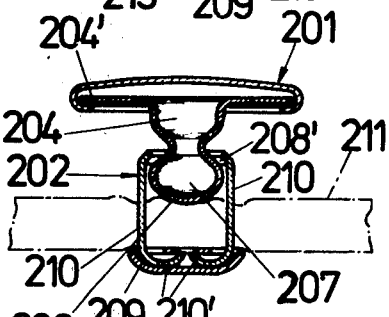
FIG. 10
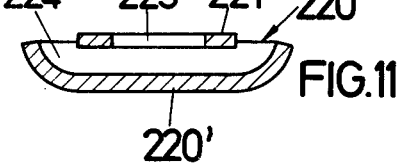
FIG. 11
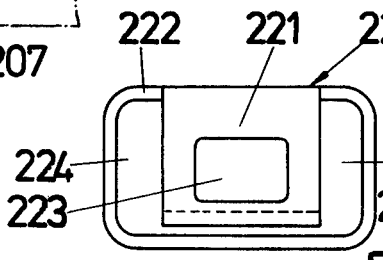
FIG. 12
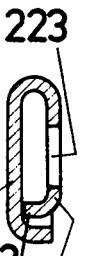
FIG. 13

BUTTON, PARTICULARLY FOR CLOTHING PIECES

This is a division of application Ser. No. 626,987 filed Oct. 29, 1975 now Pat. No. 4,033,012.

The invention relates to a double-layer counter plate, particularly for closure elements, by which the inner layer is formed integrally with the outer layer, the former overlapped by the claws of the closure and the latter serving as an abutment support during rolling of the claws theein, and by which the inner layer is supported opposite the outer layer.

Corresponding counter plates are suited for the securing of closure elements such as buttons, releaseable fasteners, snap fasteners, etc., which are secured by clamping of the carrier material on the carrier means such as clothing pieces, pockets, satchels, etc., whereby as a result of the double-layer formation of this counter plate the claws are completely covered.

It is an object of the invention, that is particularly in addition to that which may be gathered from the specification and claims, to produce a double-layer counter plate of the introductory mentioned type which is more favorable in assembly, stabler and simpler to produce and brings about an advantageous use and service such that in a more favorable way, a bending up of the inner layer of such a counter plate on the basis of the force actions of the carrier material as well as a deformation of the claw - guide channels are avoided in a positive and guaranteed manner.

It is another object of the present invention to aid in the solution of the above-mentioned object by providing a support (leg) bent from the inner layer and resting with one edge thereof against an inner surface of the outer layer and supporting the inner layer and the outer layer opposite from one another.

As a result of such formation in accordance with the present invention an advantageous coordination as well as a counter plate which is stable in use is provided. The two layers are held advantageously spaced keeping free precisely preset intermediate spaces and are supported opposite one another so that erroneus fastenings or mountings are most extensively avoided. The supporting thereof is formed in a simpler manufacturing manner by the support which is bent-off from the inner layer. This support is supported with one of its narrow edges on the inner surface of the outer layer. Its opposite narrow edge may then be overlapped by a security strip which extends from the corresponding edge of the outer layer. In this manner the danger of a high bending of the stays forming the inner layer, as it can occur in practice perhaps due to the force action of the carrier material, is counteracted in a simpler and more operationally complete manner. Since the corresponding overlapping engagement of the security strip occurs during manufacturing practically as the last assembly phase, such a counter plate permits of formation in sequential folding steps, thus in principal substantially in the sense of a "rolling-in". This considerably facilitates the manufacturing, which in this manner also is not to be limited to specific sizes of such counter plates. By the structural measure that the security strip projects in an opening of the inner layer, and by means of the corresponding position of the folding zone of the support, it is achieved that the security strip directly overlapping engages the opposite narrow edge of the support. Furthermore the opening can receive the security strip so that the counter plate has a completely planar support surface. A corresponding plane and smooth, respectively, formed counter plate prevents rubbing or chafing and moreover prevents the danger of injury. The opening furthermore leads to the formation of the holding stays which on one hand permit the claws to be able to roll-in unhindered, whereby they grip these stays, which finally leads to an optimum fastening. In the manner that furthermore the guide surfaces for the rolling-in of the claws merge as laterally directed flange surfaces, on the one hand a stabilizing of this edge range forming the guide surfaces is attained, and on the other hand an increased support surface for the counter plate is achieved, which conceals or covers the zone of the claws yet safely out of view also with greatest possible lateral movements depending on the composition or quality of the carrier material, so that a satisfactory visual form is present. The still met structural measure that the outer layer is yet formed with an inwardly directed arch in its center section leads, without expense worth mentioning, to a construction form of the counter plates by which the fastening elements themselves can find use with different spacings of the teeth.

By bending back of a stay of a double-layer counter holder plate which extends from one of the side edges, the engagement openings for the securing claws are formed in a simple manner by a corresponding two-sided open region without stamp- or punch-outs, whereby the stay itself indeed can be supported on the inner cap surface without obstructing the penetration of the claws by means of an end sided bent support leg.

Furthermore in order to avoid a bending up of the concealed plate which serves as a counter holder means, for example, by the force effect of the support or carrier material as well as a consequential deformation resulting therefrom of the guide channels for the securing claws, and beyond that to assure that the claws are always perfectly hook-like formed during assembling, according to the invention it is proposed that the concealed plate is formed as a double location or double layer member, such that the inner layer portion is supported against the inner surface of the outer layer portion and the inner location is secured against bending up during loading.

In accordance with the invention it is hereby advantageous that the two layers or locations are integrally formed.

Further it is favorable in accordance with the invention that a securing or safety effecting strip projects in an opening of the inner layer and grips hook-like behind the support, supporting itself against the inner side of the outer layer.

Then it is advantageous according to the invention that the opening of the inner layer forms two retainer stays and thus makes possible a hook-shape formation of the securing claws during the fastening or mounting operation.

The invention further provides the proposal that the deflection or guide surfaces and/or the side walls are formed flange-shaped.

Finally it is still of advantage according to the invention that the center section of the outer layer has an arch.

The retainer plate forms practically a force-like closed hollow body with radially formed deflection or guide surfaces for the securing claws of the locking element. The integrally side connected inner layer has two retainer stays for the securing claws and a break-through opening, which allows a hook-like formation, that is further curling or rolling-up of the securing claws. The inner layer is supported surely on the inner surface of the outer location, such that a deformation of the guide channels for the claws is avoided during assembling and fastening. The safety or securing strip, likewise as the inner layer itself, is an integral part of the concealed counter holder plate. Due to the channels formed by the radially shaped deflection or guide surfaces, the counter holder plate acts as the stamp or die of a mounting or assembly tool. For the mounting tool itself, therefore in view of the formation of the surface and of the precision, fewer requirements are set than with a mounting tool which directly forms the claws during the mounting or assembly. It can be carried out cheaper and quicker. The flange shaped formation of the lateral or side side walls of the concealed plate safeguard the carrier material against cutting action and reduces the specific loading on the mounting position. The hidden, covered plate also makes possible a satisfactory visual design of the mounting position; it does not need to be covered.

Also without a double location or layer formation of the concealed plate, in order to be able to stabilize the latter so that deformations are avoided during the application of the securing tool, the invention further provides deflection channels of a circularly shaped concealed plate, the deflection channels having in cross-section a substantially closed annular form, and radially directed stamp-out portions on the deflection or guide surfaces of the deflection channels, the surfaces between the guide surfaces forming guide channels for the securing claws.

Due to this stamping, the surface of the concealed plate which faces outwardly in the direction of the mounting tool is substantially stabilized. Thereby, stampings formed, for example, by displacement of material, nevertheless can be attained, so that, the outer surface is maintained completely smooth (e.g. FIGS. 23, 24). On the other hand according to the use of the button a corrugated or waved stamping can produce a structural or construction form of the outer surface (e.g., FIG. 26). In addition to the advantage of increased stability, the stampings, which are centered at equal distances radial to the center point, provide that the intermediate spaces between the individual stampings form guide channels for the securing claws. In this manner not only are the securing claws prevented from being uncontrollably displaced, possibly in disturbing position above each other during combination of the construction parts, but but rather a uniform alignment of all securing claws is formed to occur, such that an optimum fastening which is equally stable in all areas is attained between the foot plate and the concealed counter holder plate. Due to the guide channels which widen toward the outer periphery of the concealed plate, moreover, a secure insertion of all securing claws is achieved by a certain equalization of spacing tolerance which occur between the individual claws.

With the above and other objects and advantages in view, the invention will become more clearly understood in the following detailed description of preferred embodiments of the invention in connection with the accompanying drawings, in which:

FIG. 6 is a longitudinal cross-sectional view of a fifth embodiment of the button, the button pin of which, which is connected with the foot part, is formed calotte-like;

FIG. 7 is a longitudinal cross-sectional view of a concealed plate in accordance with the invention;

FIG. 8 is a side cross-sectional elevational view of FIG. 6;

FIG. 9 is a cross-sectional elevational view of the concealed plate taken in the same direction;

FIG. 10 is a cross-sectional elevational view of the button of FIG. 6 secured to the concealed plate of FIG. 7 and connected to the carrier material;

FIG. 11 is a cross-sectional elevational view of another embodiment form of the concealed plate;

FIG. 12 is a top plan view of FIG. 11;

FIG. 13 is a lateral central cross-section through FIG. 12;

Figure 2:
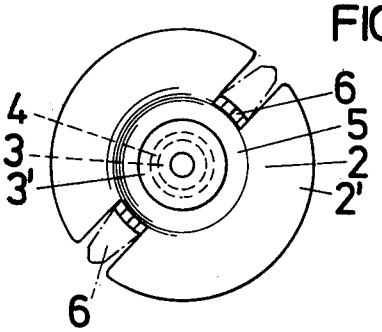
FIG. 2 is a bottom view of the foot part of FIG. 1 and showing the rivet-like widened tilting pin therein.

The button according to a first embodiment form of the invention (FIGS. 1–2) comprises substantially a button plate 1, a foot or base part 2, and a counter punch plate 8 which serves for the fastening on the carrier or textile material 7.

The button plate 1 extends from an upper flat annular surface into a central hollow pin constituting a wobble or tilting pin 3. The latter passes with play through an insert opening 4 of the foot part 2, the latter having a pot-like shape. The play is adjusted according to the degree of tiltability and loosenness, respectively, which is desired of the button plate, as well as the height T of the pot-hollow 5 (i.e., the cavity 5 defining the pot-shape).

The free end of the pin 3 is widened by riveting at portion 3', so that the button plate 1 is anchored onto the head end of the foot part 2. The riveting takes place without impairing the button plate 1, during which operation one assembly tool is placed on that annular edge of the head surface of the foot part 2 which is adjacent to the insert opening 4 and constitutes an assembling tool-support surface St, while the other assembly tool is inserted in the easily accessible pot-hollow 5.

For the fastening of the button which is assembled in this manner, pointed securing claws 6 are cut free from the material of the pot edge 2' and are bent in the direction of a securing base to be clamped, the base being in the form of a carrier material or the like. If this is to have a relatively high rigidity, it suffices to pess the securing claws 6 into the position illustrated by the dashed-dotted line; the clamping of the carrier material 7 also can take place still by use of the counter plate 8. The latter has break-through openings 9 in the range of the securing claws 9. The displaced material forming the openings 9 forms a contrl runner or slide 10 for the securing claws 6, which fold back by pressing the parts 2 and 8 against each other with clamp the carrier material therebetween.

The button plate 1 can be provided with an ornamental cover 11. The latter may be held thereon in the manner of a clip or snap-on connection. its fitting thereon takes place after conclusion of the riveting, so that the entire distance x between the support surface St for the assembling tool an the lower side 1' of the button plate is available for use.

Figure 1:
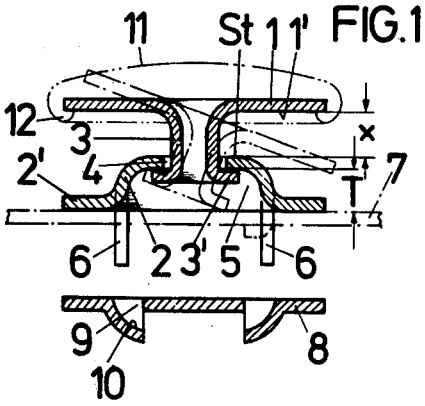
FIG. 1 is a longitudinal cross-sectional view of a button formed in accordance with the invention in unsecured condition, according to a first embodiment.
Figure 3:
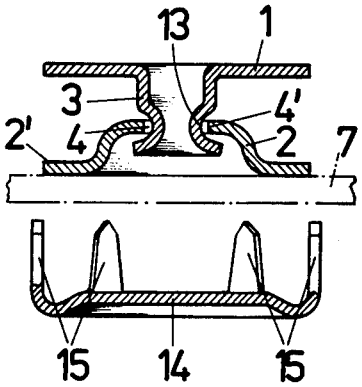
FIG. 3 is a longitudinal cross-sectional view of second embodiment of a button in accordance with the invention in unsecured position with a claw equipped counter retainer plate.

The embodiment of FIG. 3 differs from that of FIG. 1, in so far as that here the wobble pin 3 has a pivot channel 13 in the range of the edge 4' of the insert opening 4. This channel 13 is developed by a corresponding annular shaped constriction of the here likewise hollow wobble pin 3. This pivot channel limits the axial penetration of the pin 3 into the inner cavity and the pot-hollow 5, respectively, of the foot part 2 by means of a corresponding cross-sectional enlargement of the pin. The end section, which is cross-sectionally reduced for the insertion of the corresponding set-off pin end, is thereafter again rivet-like widened.

With this embodiment a claw plate 14 is used. Its securing claws 15, which are arranged on its periphery, pass through the carrier material 7 and finally are bent over the pot edge 2'.

Figure 4:
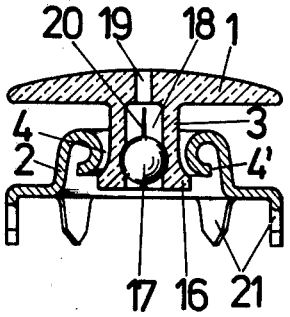
FIG. 4 is a longitudinal sectional view of a third embodiment of a button illustrating a spreader means facilitating a toolless assembling of the button plate and the foot part.

By the embodiment according to FIG. 4, an assembling of the button is made possible without any work tool. The pin 3 of the button plate 1 is here formed a a hollow pin. Its free end is thickened, forming a widened portion 16. By means of a longitudinal slotting, fornibg slot 20 of the wall of the pin, the cross-section of the pin at that place can be enlarged by insertion of an expander body 17, in the form of a ball, so that also here there is realized an anchoring of the button plate 1 on the foot part 2. The button plate 1 is preferably made of synthetic material. The ball bearing is adjusted complementary to the convex shape of the ball, so that the ball can not slip.

The insert opening 4 is formed by curling or turning-over the foot part 2. In this manner the edge 4' of the rim of the metal foot art, which edge forms a cut, is placed out of contact with the tilting pin, the latter being preferably produced of synthetic material, and thus a substantially therefrom resulting source of wear and tear is avoided. By pushing the expander body 17 out, which is possible by means of a nail, stud or the like. via a stick-through insert opening 9 aligned with the axle hollow 18, the enlarged end 16 of the pin can step back or return to a position behind (i.e., smaller than) the diameter of the insert opening 4; the button plate 1 is then detachable. By this embodiment the securing claws 21 which clamp the carrier material originate from the edge of the foot part 2.

Figure 5:
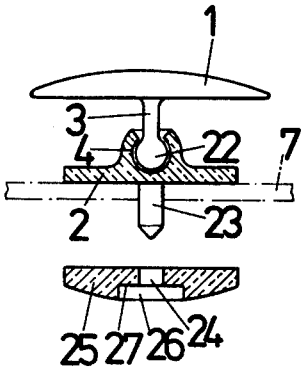
FIG. 5 is a longitudinal view of another embodiment of a button with the foot part and the counter retainer plate in cross-section made preferably of a thermoplastic material.
Figure 14:
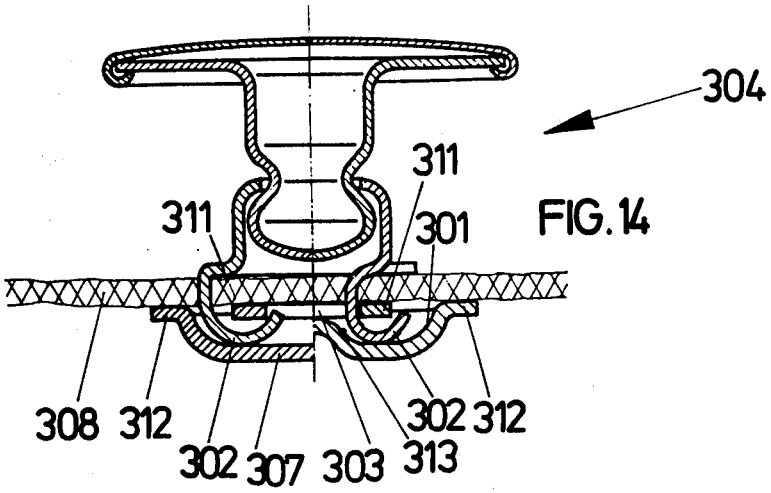
FIG. 14 is a cross-sectional elevational view of a sixth embodiment of the button having a concealed plate coordination showing varied two use forms, and illustrated in secured condition.
Figure 15:
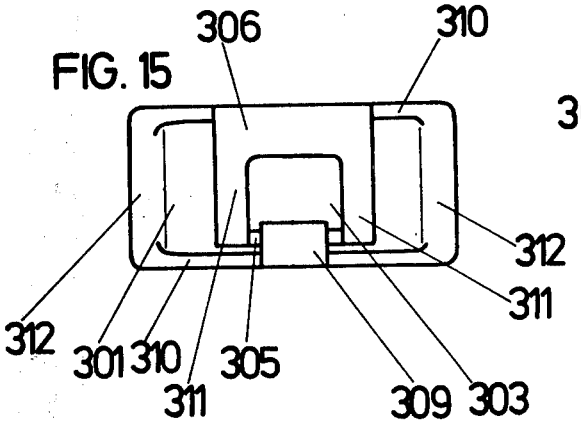
FIG. 15 is a plan view of the concealed plate of FIG. 14.
Figure 16:
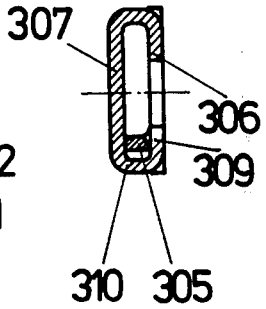
FIG. 16 is a lateral central cross-section through the concealed plate of FIG. 15.
Figure 17:
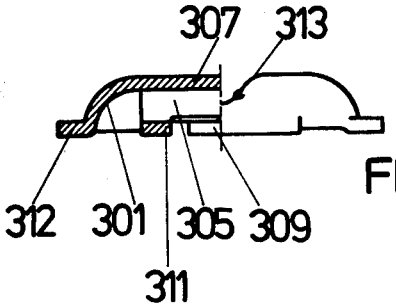
FIG. 17 is a reversed view of the cover plate of FIG. 14, half in section and half in elevation.

In accordance with a fourth embodiment of the invention (FIG. 5), the tilting pin 3 which originates from the button plate 1 has a ball head 22 on its free end, the ball head snapping-in the insert opening 4 of the foot part 2. The pin 3, and the mouth section opening into the snap-catch recess 4 of the foot part 2, are so dimensioned that also here the tilting or pivotal positions of the button plate 1, as indicated in dashed-dotted lines in FIG. 1, are attained.

The foot part 2, produced in the present embodiment of synthetic material, extends in a central pin or spike 23. The latter pierces through the carrier material 7 and enters a break-through opening 24 of a counter holding plate 25. The break-through opening 24 continues into a recess 26 having a larger diameter. The latter forms a retaining shoulder 27 for the pin 23, the pin being deformable by heat in an advantageous way by the use of thermoplastic synthetic material.

The button in accordance with the invention as shown in FIGS. 6–13, also essentially comprises a button plate 201, a foot part 202 and a concealed plate 209. The button plate 201 is formed cap-shaped and has a lower sided turned back edge 201', which leaves free, i.e., defines, a central opening 203. This central opening 203 serves for the fastening of a pin 204 which is directed downwardly again centrally relative to the button plate, while the upper outwardly directed edge zone 204' thereof engages behind the turned back edge 201' of the button plate 201.

The pin 204 is formed as a hollow pin and possesses an annular groove 205 substantially in the center section of the pin. The pin 204 extends into a substantially ball shaped section 207, the lower front surface 206 of which is formed as a hemispherical calotte.

The operative connection of the button plate 201 with the foot part 202 is brought about by means of the pin 204, by the lower side ball-shaped section 207 of the pin being pressed-through into the pot-interior space of the foot part 202, through an uppermost opening 208 of the pot-shaped foot part 202.

The largest cross-section of the ball shaped section 207 is thereby greater than the diameter of the penetration or insert opening 208 of the foot part, so that the pressing-in of the pin 204 in the foot part 202 occurs as a type of elastic clip or snap connection. After the pin is pressed in, the edge of the penetration opening 208 of the foot part 202 can additionally be bent in for a yet stable axial securing of the pin. In the pressed-in position of the pin, the annular groove 205 lies at the level of the opening edge of the opening 28 of the foot part. The button plate 201 is thus moveable axially relative to the pin axis as well as freely tiltable on all sides to a certain degree.

In order to coordinate the button to the carrier material, for example, a clothing piece, it is fixed by the aid of a concealed plate 209 serving as a counter holder means. The inner, that is, the material-sided location thereof is designated with the reference character 209' and can be formed of two stays originating from the edge of the concealed plate which are bent toward each other. The pot-shaped foot part 202 has downwardly directed projecting securing claws 210, which by passing through the carrier material 211 penetrate in correspondinly arranged penetration openings 212 of the concealed plate floor 209' and meet on the deflection channels 213 which turn around the free ends 210' of the securing claws 210 so that they grip back the inner location 209'. In this way the foot part 202 of the button and the concealed plate 209 are braced against each other, with intermediate positioning of the carrier material 211, whereby the lower edge 202' (FIG. 8) of the foot part 202 is bent for a large surface support on the carrier material.

After this anchoring of the button on the carrier material, the zone of the ball-formed section 207, which lies adjacent the groove 205 is supported on the complementary, slight ball-shaped or arcuate running inside edge portion of the upper sided pot-opening edge 208' on one side and on the other side with the calotte shaped front surface 206 on the elastically pressable carrier material 211.

In spite of the free moveability of the button plate 201, thus there is obtained a certain position fixing of the tilting pin 204 of the type such that the button can not freely swing or tilt downwardly due to its weight.

The different embodiment shown in FIGS. 11–13 of the concealed counter holder plate 220 has one continuous traversing stay forming the inner layer 221, which stay is correspondingly bent out from one cross edge 222, and has an opening 223 in the center range. The free end 225 of this stay is bent of in the direction of the cap portion 220' of the concealed plate 220', which cap 220' forms the outer layer 220', the free end 225 constituting a support leg 225 which is supported with its front face on the outer layer 220'. The penetration openings 224 for the bending claws remain open between one of the lateral side edges of the covered counter holder plate 220 and the adjacent lateral edges of the stay 221, respectively.

The double-layered covered counter holder plate formed from a blank according to the embodiment of FIGS. 14–17, likewise has radially formed channels 301 forming deflector channel or guide stabilizing surfaces, i.e., abutment means which during the mounting process causes the hook shaped roll-in formation of the securing claws 302.

The central opening 303 in the inner layer 306 of the counter holder plate forms two retainer stays 311 and thus causes the securing claws 302 to be able to extend back in the carrier material 308 and by their hook form and the double passing-through of the carrier material 308 to provide the button or closure part 304 with a secure hold on the carrier material 308.

An arch 313 may be provided in the center section of the counter holder plate which permits also locking elements to be mounted such that their securing claws 302 are inserted through the central opening 303 of the inner layer 306 of the counter plate and likewise by turning around roll in hook-like shape outwardly.

The inner layer 306 integrally extends from a transverse side wall 310 of the outer layer 307.

The inner layer 306 is supported opposite to the outer layer 307. The support 305 is likewise integrally attached to the inner layer 306 of the counter holder plate and is bent inwardly relative thereto; it is supported sitting with its narrow edge on the inner surface of the outer layer 307.

A security strip 309, which likewise is integrally attached to the edge of the opposite transverse side wall 310 of the outer location 307 of the counter holder plate, overlappingly engages over the opposite central narrow edge of the support leg 305 between the two retainer stays 311 and projects into the opening 303.

The diametrically formed channels 301 and/or the side walls 310 form laterally directed flange faces 312 which engage the bottom of the carrier material 308.

In the embodiment of FIGS. 8–26, a concealed counter plate plate 409 is shown, the deflection channels 413 of which are bent such that they form in cross-section approximately closed rings.

Figure 23:
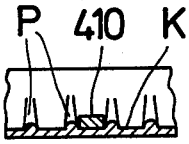
FIG. 23 is a section taken along the lines A—A of FIG. 18 in development.
Figure 24:
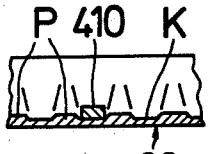
FIG. 24 is a view corresponding to that of FIG. 23 illustrating a variant guide channel.
Figure 25:
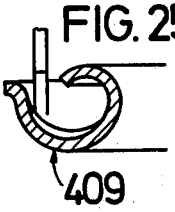
FIG. 25 is a cross-section taken in the range of a guide channel.

The guide surfaces formed by the deflection channels 413 of the here circularly-formed concealed counter slate plate 409 are provided with stamped-out portions P which are radially directed to the center point, and which add stability to the cap-shape of the plate. The spacing remaining between the individual stampings moreover forms guide channels K for the securing claws 410. As illustrated in FIGS. 23 and 24, the number of the guide channels can be varied by differently dimensioning of the stamp-outs; besides, here a material-removed stamp-out is illustrated of a type such that the free outer surface of the concealed plate is completely smooth and even. channel K just prior to the rolling in of the securing claws.

Figure 26:
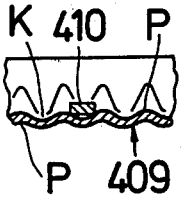
FIG. 26 is a view corresponding to that of FIG. 23 of another embodient thereof having guide channels which are stamped from the outer side.

FIG. 26 illustrates a corrugated stamping (noting the shaded cross-section portion showing both the interior surface side with the channel K formed by the corrugations, in which the claw 410 is guided, as well as the corrugated exterior side surface pointed to by the arrow head 409), by which the ribs, which are also directed outwardly and star-shaped serve as structural elements of the counter holder plate. According to FIGS. 18 and 19 the deflection channels 413 of the counter holder plate are directed inwardly towards each other in a manner whereby the cross-section can be kept small.

Figure 18:
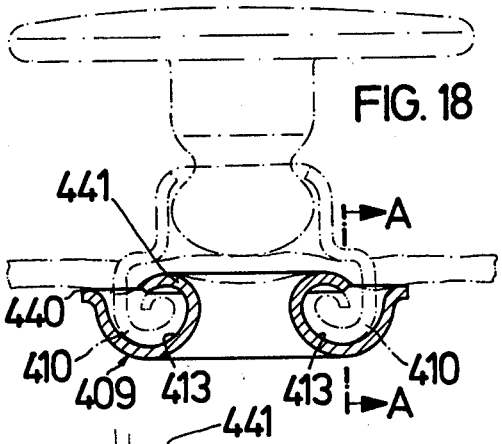
FIG. 18 is a longitudinal cross-sectional elevational view of another embodiment of a concealed plate in accordance with the invention.
Figure 19:
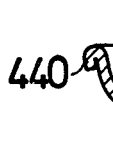
FIG. 19 is a similar view of a variant of FIG. 18 partially broken away.

The outer edge 440 thereby lies slightly deeper than the bent back inner edte 441, the latter forming a rear cut for the rolled-in bending claws 410. In order to avoid cutting of the outer edge 440 into the carrier material, the edge 440 as illustrated in FIG. 18 is bent planarly outwardly, or as illustrated in FIG. 19 is completely bent back into a rounded-off engagement shoulder.

Figure 20:
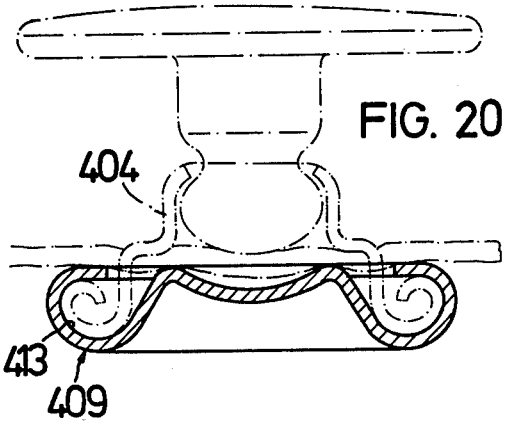
FIG. 20 is a similar view of a modified embodiment of a concealed plate.
Figure 21:
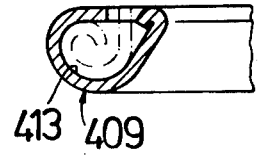
FIG. 21 is a similar view of a variant of FIG. 20 partially broken away.
Figure 22:
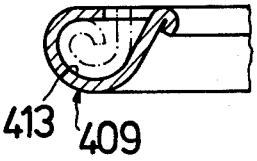
FIG. 22 is a view similar to FIG. 21 showing a modification therefrom.

By the embodiments shown in FIGS. 20–22 of the concealed plate, the deflection channels 413 are formed outwardly in opposite directions so that the securing claws of the foot part 404 are rolled-in outwardly.

Also here the contact zones which are associated with the carrier material are formed correspondingly surface rounded in order to prevent a scratching or cutting therein. FIG. 21 shows the annularly counter holder plate 409 having its inner edge bent back in an outward direction, whereas FIG. 22 shows a similarly formed embodiment with the inner edge bent back in an inward direction.

While we have disclosed several embodiments of the invention, it is to be understood that these embodiments are given by example only and not in a limiting sense.

We claim:

1. A double layer counter holder plate, particularly adapted to hold closure members having claws, comprising an inner layer adapted to abut a carrier material and to be overlapped by the claws of a closure member, an outer layer, integrally formed at only one common end with said inner layer, and constituting an abutment means for rolling the claws therein, means for supporting said inner layer spaced opposite to said outer layer comprising a stay support bent substantially from a free end of said inner layer, said outer layer defining an inner surface facing said inner layer, said support defining a free edge, said support sitting with said free edge on said inner surface of said outer layer.

2. The double layer counter holder plate as set forth in claim 1, wherein said inner and outer layers are substantially planar and spaced uniformly parallel to each other.

3. The double layer counter holder plate as set forth in claim 2, wherein said stay support constitutes said free end and extends perpendicularly to said inner and outer layers.

4. The double layer counter holder plate as set forth in claim 3, wherein said outer layer is cap-shaped including a flat central portion and peripheral edges extending therefrom substantially perpendicularly relative thereto in a direction substantially towards said inner layer, one of said peripheral edges is integrally connected to said inner layer at said common end, and the remainder of said peripheral edges terminate freely laterally and forwardly spaced, respectively, from said inner layer, said inner layer defines an outer surface adapted to abut the carrier material, said remainder of said peripheral edges have terminal ends located at a level at most equal to the level of said outer surface of said inner layer.

5. The double layer counter holder plate as set forth in claim 4, wherein said terminal ends of said peripheral edges are located at a level short of the level of said outer surface of said inner layer.

6. A double layer counter holder plate, particularly adapted to hold closure members having claws, comprising an inner layer adapted to face a carrier material and to be overlapped by the claws of a closure member, an outer layer integrally formed with said inner layer and constituting an abutment means for rolling the claws therein, means for supporting said inner layer spaced opposite to said outer layer comprising a support bent from said inner layer, said outer layer defining an inner surface facing said inner layer, said support defining a free edge, said support sitting with said free edge on said inner surface of said outer layer, said inner layer defines a central opening, said inner layer is laterally shorter than said outer layer and has lateral edges defining penetration openings laterally relative thereto for receiving said claws.

7. A double layer counter holder plate, particularly adapted to hold closure members having claws, comprising an inner layer adapted to face a carrier material and to be overlapped by the claws of a closure member, an outer layer integrally formed with said inner layer and constituting an abutment means for rolling the claws therein, means for supporting said inner layer spaced opposite to said outer layer comprising a support bent from said inner layer, said outer layer defining an inner surface facing said inner layer, said support defining a free edge, said support sitting with said free edge on said inner surface of said outer layer, said support defines opposite narrow edges, one of said opposite narrow edges constitutes said free edge, a security strip overlappingly engaging the other of said narrow edges of said support, said security strip extending from an edge of said outer layer.

8. The double layer counter holder plate as set forth in claim 7, wherein said inner layer defines a central opening, said security strip projects in said central opening abutting said other narrow edge of said support.

9. The double layer counter holder plate as set forth in claim 7, wherein said inner layer defines a central opening forming two retainer stays, said central opening and said two retainer stays and said abutment means are cooperatively adapted to facilitate a hook-shaped engagement formation of the claws during an assembling operation.

10. The double layer counter holder plate as set forth in claim 9, wherein said support extends integrally from and between said two retainer stays.

11. The double layer counter holder plate as set forth in claim 7, wherein said abutment means forms deflector surfaces on which the claws roll-in and wherein, laterally directed flange surfaces are joined to said deflector surfaces.

12. The double layer counter holder plate as set forth in claim 7, wherein said outer layer has transverse side walls which are flange shaped and disposed at the level of said inner layer.

13. The double layer counter holder plate as set forth in claim 7, wherein said outer layer has a center section formed with an arch directed inwardly toward said inner layer.

14. The double layer counter holder plate as set forth in claim 7, wherein said other narrow edge of said support is disposed at a level offset relative to an exterior surface of said inner layer, said exterior surface adapted to abut the carrier material, said security strip includes an outer surface aligned with said exterior surface of said inner layer.

15. A button, particularly for clothing pieces including a carrier material in fastened condition, comprising a foot part having a wall formed in the shape of a vertically oriented open ended hollow member defining a hollow cavity therein, said foot part having a lower peripheral edge defining a lower opening communicating with said cavity and abutting an upper side of the carrier material and clamping claws integrally extending from said wall and non-rotatably clamping said peripheral edge and the carrier material and piercing through the latter, a button plate operatively freely selectively tiltably seated on said foot part, a tilting pin secured to said button plate, said tilting pin having a bulge-shaped lower end, said foot part having an upper head end, the latter being formed with an insert opening communicating with said hollow cavity and freely tiltably mountably receiving said bulge-shaped lower end of said tilting pin therein, a counter holder plate abutting an underside of the carrier material, and having curved deflection channel means for turning said clamping claws around pointing upwardly in said counter holder plate in a direction toward said hollow cavity, said securing claws passing downwardly through said carrier material and engaging said counter holder plate in non-rotatable position relative to said carrier material, entering said deflection channel means thereby being turned upwardly, cooperatively clamping and pressing the carrier material against said peripheral edge of said foot part, said counter holder plate constituting a covered plate, the latter having cross-edges and having only one central stay adapted to abut the carrier material forming an inner layer of said covered plate, said stay extending bent from one of said cross-edges and having free lateral edges on both sides of said stay defining penetration openings adjacent said lateral edges on both sides of said stay, said covered plate having a cap-shaped outer layer spaced opposite from said inner layer having therewith a U-shape cross-section, said outer layer defining said curved deflection channel means aligned with said penetration openings, said stay being formed with one opening therein and having a free end bent from said inner layer, said free end constitutes a support leg means for supporting said stay, said support leg means having a free edge abutting an inner surface of said outer layer, said inner surface facing said stay.

16. A double layer counter holder plate particularly adapted to hold closure members having claws and cooperating therewith to clamp a carrier material between the closure member and the counter holder plate, comprising a cap-shaped outer layer having cross edges, one central stay adapted to face the carrier material and forming an inner layer, said stay extending integrally from one of said cross edges of said outer layer forming a U-shape therewith, said stay having free lateral edges on both sides of said stay defining penetration openings adjacent said lateral edges on both sides of said stay, said cap-shaped outer layer spaced opposite from said inner layer, said outer layer defining deflection means aligned with said penetration openings for rolling of the claws of the closure members therein, said stay being formed with one opening therein and having a free end bent from said stay in a direction toward said outer layer and constituting a support supporting said stay spaced from said outer layer, said support having a free edge abutting an inner surface of said outer layer, said inner surface facing said outer layer.

17. A double layer concealed single piece counter holder plate particularly adapted to hold closure members having claws and cooperating therewith to clamp a carrier material between the closure member and the counter holder plate, comprising a circularly-formed concealed counter holder plate adapted to be disposed out of sight on a rear side of a carrier material, said counter holder plate being integrally formed in one-piece with deflection channels, the latter having a substantially closed ring form, said deflection channels include integral one-piece guide surfaces having stamp-out portions radially directed relative to a center point of said circularly-formed counter holder plate, said stamp-out portions defining therebetween intermediate spaces forming guide channels means for guiding the claws of the closure member therein.

18. A double layer concealed counter holder plate particularly adapted to hold closure members having claws and cooperating therewith to clamp a carrier material between the closure member and the counter holder plate, comprising a circularly-formed concealed counter holder plate adapted to be disposed out of sight on a rear side of a carrier material, said counter holder plate being formed with deflection channels, the latter having a substantially closed ring form, said deflection channels include integral guide surfaces having stamp-out portions radially directed relative to a center point of said circularly-formed counter holder plate, said stamp-out portions defining therebetween intermediate spaces forming guide channels means for guiding the claws of the closure member therein, said counter holder plate defines a radially outer wall, said integral guide surfaces and said guide channels means are located at least in said outer wall, said guide channels means have a width substantially equal to that of the claws and widen in an outer peripheral direction.

19. The double layer concealed counter holder plate as set forth in claim 18, wherein said stamp-out portions constitute stampings forming corrugated surfaces on both interior and exterior sides of said counter holder plate.

* * * * *